US009528771B2

(12) United States Patent
Mandelcorn et al.

(10) Patent No.: US 9,528,771 B2
(45) Date of Patent: Dec. 27, 2016

(54) HEAT EXCHANGER WITH NON-LINEAR COIL

(71) Applicant: Hussmann Corporation, Bridgeton, MO (US)

(72) Inventors: Timothy Mandelcorn, Rancho Cucamonga, CA (US); Anand G. Rajagopalan, Irvine, CA (US); Glen P. Roumayah, Ontario, CA (US); Al Arrosagaray, Rancho Cucamonga, CA (US)

(73) Assignee: Hussmann Corporation, Bridgeton, MO (US)

( * ) Notice: Subject to any disclaimer, the term of this patent is extended or adjusted under 35 U.S.C. 154(b) by 303 days.

(21) Appl. No.: 14/524,985

(22) Filed: Oct. 27, 2014

(65) Prior Publication Data

US 2016/0116220 A1 Apr. 28, 2016

(51) Int. Cl.
*F28F 1/00* (2006.01)
*F28D 7/04* (2006.01)

(52) U.S. Cl.
CPC ..... *F28D 7/04* (2013.01)

(58) Field of Classification Search
CPC ..... F28F 1/36; F28F 1/00
USPC ..... 165/177, 184, DIG. 406, DIG. 438,165/DIG. 437, DIG. 436, DIG. 496, DIG. 497,165/DIG. 535
See application file for complete search history.

(56) References Cited

U.S. PATENT DOCUMENTS 4,362,028 A 12/1982 Armstrong
4,510,891 A * 4/1985 Bindl ..... F24H 1/208 122/15.1
4,617,807 A 10/1986 Pritchett et al.
5,682,947 A 11/1997 McFarlane
5,762,887 A 6/1998 Girod et al.
5,787,722 A * 8/1998 Jenkins ..... F25B 39/04 165/162
6,098,418 A 8/2000 Kyees
6,158,235 A 12/2000 Hawkins, Jr. et al.
6,185,951 B1 2/2001 Lane et al.
7,123,479 B2 10/2006 Chang et al.
7,942,137 B2 5/2011 Geskes et al.
8,191,385 B2 6/2012 Wei et al.
9,456,707 B2 * 10/2016 Moody ..... A47F 3/0408
9,462,896 B2 * 10/2016 Reichert ..... A47F 3/043
2003/0102112 A1 * 6/2003 Smithey ..... F28D 1/0473 165/150
2007/0175231 A1 * 8/2007 Arrosagaray ..... A47F 3/0434 62/246

(Continued)

FOREIGN PATENT DOCUMENTS

EP 1724543 11/2006

OTHER PUBLICATIONS

Written Opinion of the International Searching Authority for Application No. PCT/US2015/043615 dated Oct. 26, 2015 (9 pages).

(Continued)

*Primary Examiner* — Justin Jonaitis

(74) *Attorney, Agent, or Firm* — Michael Best & Friedrich LLP

(57) ABSTRACT

A heat exchanger including a non-linear coil. The coil has coil sections that define a sinuous refrigerant path, and the coil has an inlet that is located on an outer periphery of the coil and an outlet that is located inward of the outer periphery. A distance between the coil sections monotonically increases from the outer periphery toward the center.

19 Claims, 8 Drawing Sheets

(56) References Cited

U.S. PATENT DOCUMENTS

| | | | | |
|---|---|---|---|---|
| 2011/0107512 | A1* | 5/2011 | Gilbert | E03C 1/00 4/596 |
| 2011/0271701 | A1 | 11/2011 | Stephens et al. | |
| 2012/0000229 | A1* | 1/2012 | Navarro | A47F 3/0439 62/249 |
| 2013/0313267 | A1 | 11/2013 | Horio et al. | |
| 2014/0260411 | A1* | 9/2014 | Rajagopalan | A47F 3/0447 62/441 |

OTHER PUBLICATIONS

International Search Report for Application No. PCT/US2015/043615 dated Oct. 27, 2015 (3 pages).

* cited by examiner

HEAT EXCHANGER WITH NON-LINEAR COIL

BACKGROUND

The present invention relates to a heat exchanger and, more particularly, to a exchanger including a non-linear coil.

Refrigeration systems are well known and widely used in supermarkets, warehouses, and other environments to refrigerate product. Conventional refrigeration systems typically include an evaporator, a compressor, and a condenser. Some merchandiser refrigeration systems are utilized to refrigerate product (e.g., meat, deli product, etc.) that is sensitive to airflow. For example, existing meat and deli merchandisers often use a linear serpentine coil that is placed at the bottom of the product display area and that conductively cools a platform (typically metal) on which product is supported.

Linear serpentine coils have a refrigerant inlet and a refrigerant outlet both on the outer periphery of the coil and disposed on opposite sides of the coil. With these conventional coils, the coil sections downstream (in the direction of refrigerant flow) of the inlet coil section have a back-and-forth arrangement such that each subsequent coil section is bent to run or extend parallel along the preceding coil section. This typically results in the outer corners of the platform being warmer than the inner area, and the interior area being subject to frost and freezing. In addition, the temperature in the product display area often can be difficult to regulate. Some meat and deli merchandisers also use a gravity coil that is placed above the product and that utilizes natural convection to further condition the product via a low velocity, gravity-driven airflow.

SUMMARY

The invention provides a heat exchanger including a non-linear coil. The coil has coil sections that define a sinuous refrigerant path. The coil has an inlet that is located on an outer periphery of the coil and an outlet that is located inward of the outer periphery. A distance between the coil sections monotonically increases from the outer periphery toward the center.

In another construction, the coil inlet is located on an outer periphery of the coil such that the coil section defining the outlet is positioned closest to and extends along a longitudinal axis of the coil. The longitudinal axis extends along a center of the coil, and the distance between the coil sections monotonically increases from the outer periphery toward the center.

In another construction, the invention provides a heat exchanger including a non-linear coil lying in a single plane and having coil sections defining a sinuous refrigerant path. The coil has a spiral shape and includes an inlet located of an outer periphery of the coil and an outlet located inward of the outer periphery. A distance between the coil sections monotonically increases from the outer periphery toward the center.

In another construction, the invention provides a refrigerated merchandiser including a case that has a base and that defines a product display area disposed at least partially above the base. The refrigerated merchandiser further includes a non-linear coil that is disposed in the case and positioned to conductively refrigerate product in the product display area. The coil has coil sections that define a sinuous refrigerant path and includes an inlet located on an outer periphery of the coil and an outlet located inward of the outer periphery. The coil is oriented in the merchandiser such that the coil section defining the inlet is positioned toward and adjacent either a front edge or a rear edge of the case.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
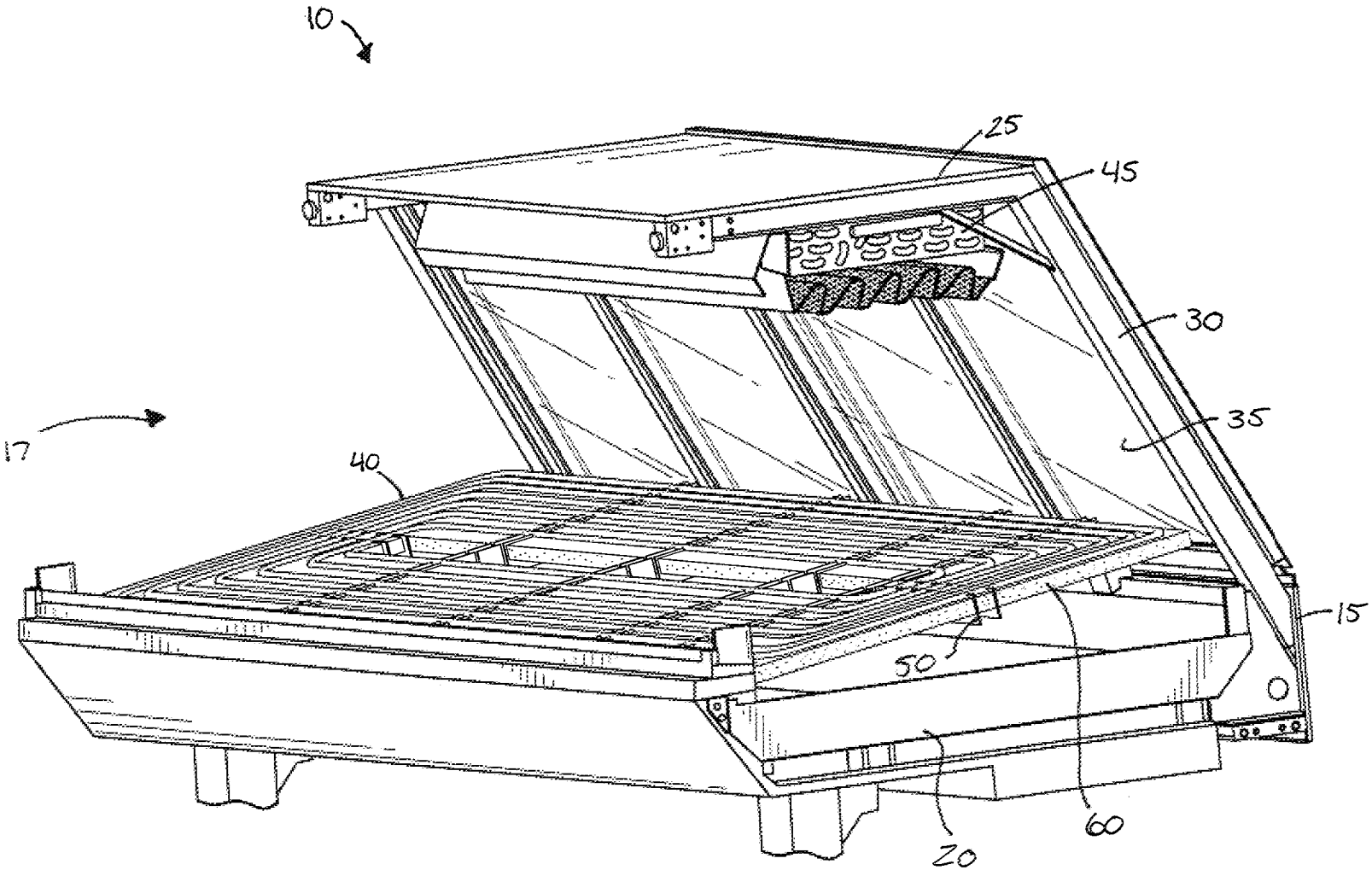
FIG. 1 is an exposed perspective view of an exemplary merchandiser including a heat exchanger embodying the present invention.
Figure 2:
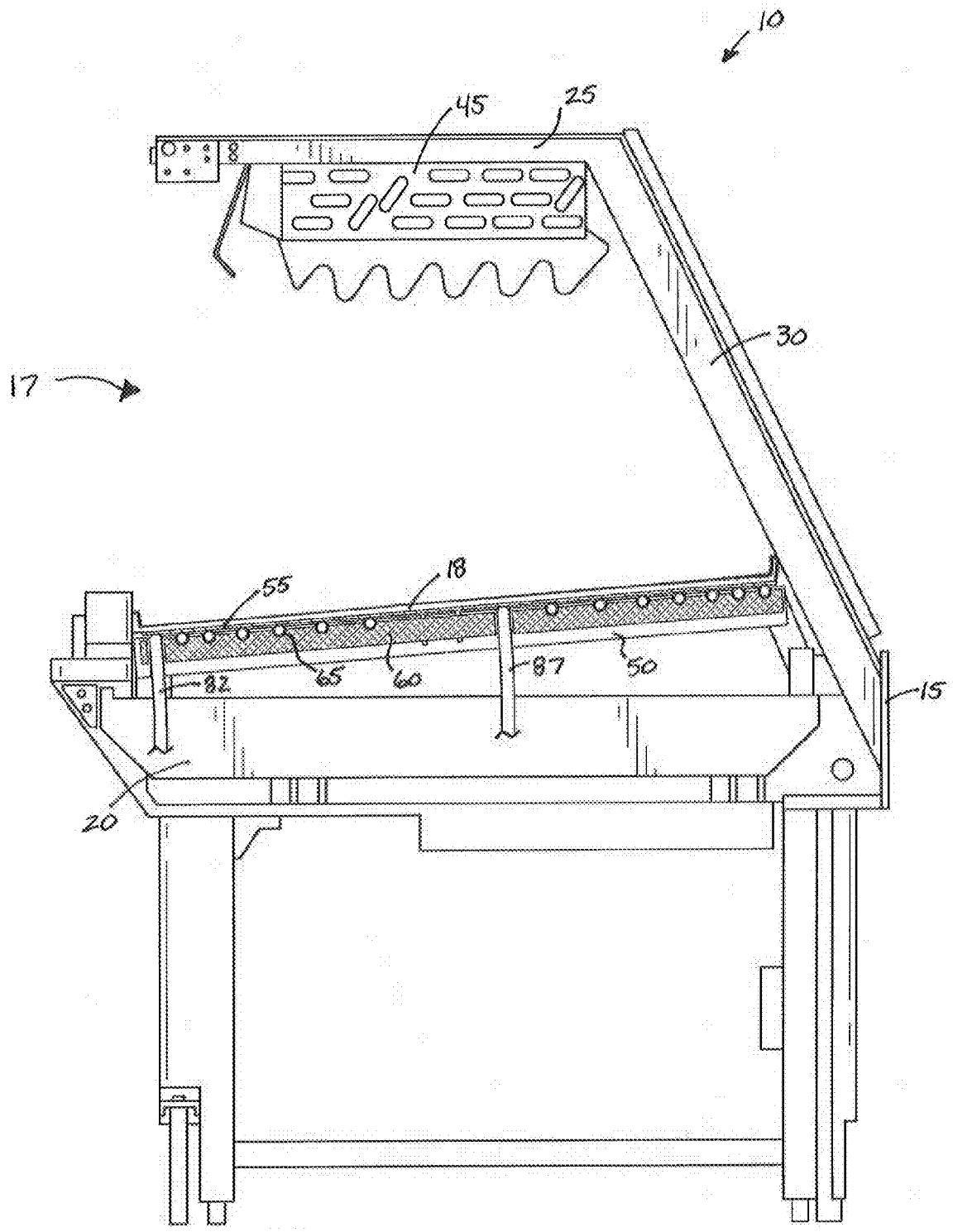
FIG. 2 is an exposed side view of the merchandiser of FIG. 1 illustrating a partial cross-section of the heat exchanger.

FIGS. 1 and 2 illustrate a portion of an exemplary merchandiser that may be located in a supermarket or a convenience store or other retail settings (not shown) for presenting fresh food, beverages, and other product (not shown) to consumers. The illustrated merchandiser 10 is a horizontal merchandiser (e.g., a meat, bakery, or deli-type merchandiser) and includes a case 15 that defines a product display area 17 in which product can be supported on one or more decks or platforms 18 (one shown). The platforms 18 are formed of a food grade conductive material (e.g., stainless steel, aluminum, etc.).

The case 15 has a base 20 and a top wall or canopy 25 that is attached to the base and is cantilevered over the product display area 17 via uprights 30. Glass panels 35 are coupled to the uprights 30 adjacent a rear edge of the case 15 to enclose the rear side of the merchandiser 10. The glass panels 35 can be fixed to the uprights 30, or the glass panels 35 can be part of one or more doors that are movably coupled to the uprights to selectively provide access to the product display area 17 from the rear of the case 15. Although not shown, one or more glass panels can be coupled adjacent or along a front edge of the case 15 to enclose the product display area 17.

The merchandiser 10 includes at least a portion of a refrigeration system (not entirely shown) that circulates a heat transfer fluid (e.g., refrigerant, coolant, etc.) to refrigerate product supported in the product display area 17. More specifically, the refrigeration system includes a heat exchanger 40 (e.g., an evaporator) that is fluidly coupled to a priming device (e.g., a compressor or a pump), which circulates refrigerant through the heat exchanger 40 and the remainder of the refrigeration system to condition the product display area 17. As illustrated in FIGS. 1 and 2, the refrigeration system can also include a gravity coil 45 that is coupled to the canopy 25 to generate a slow-moving refrigerated airflow to further condition the product display area 17. The gravity coil 45 is well known in the art and, as such, will not be described in detail.

Figure 3:
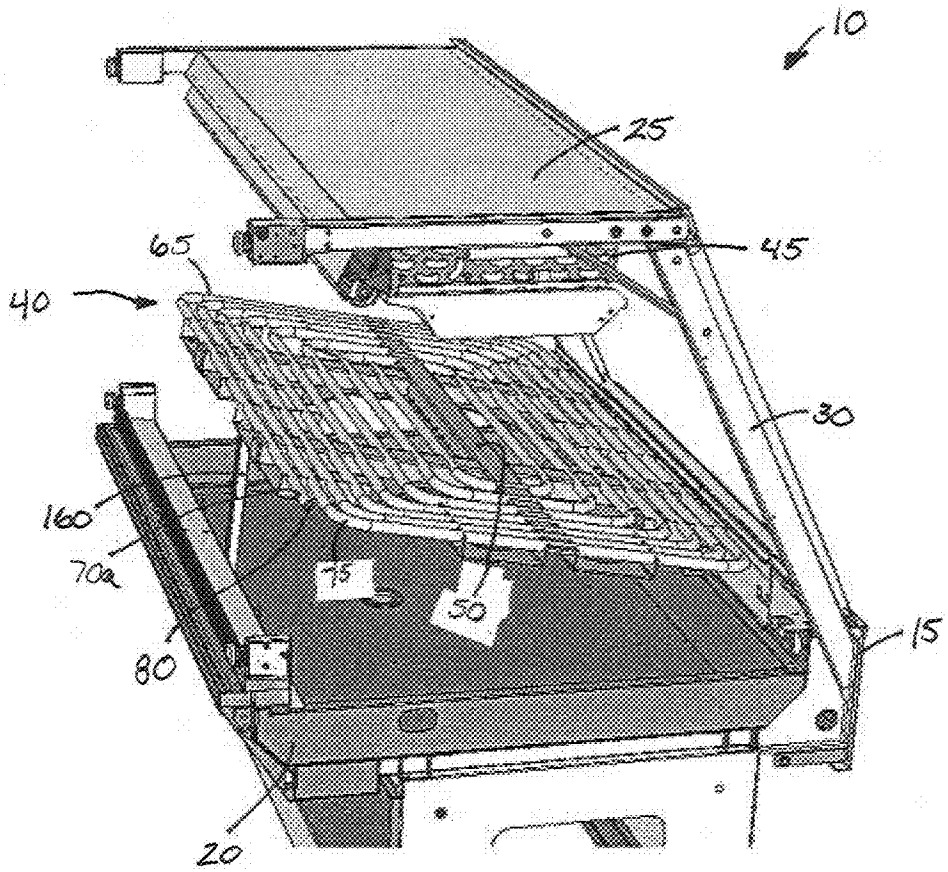
FIG. 3 is another perspective view of the merchandiser illustrating the heat exchanger and a frame supporting the heat exchanger.
Figure 4:
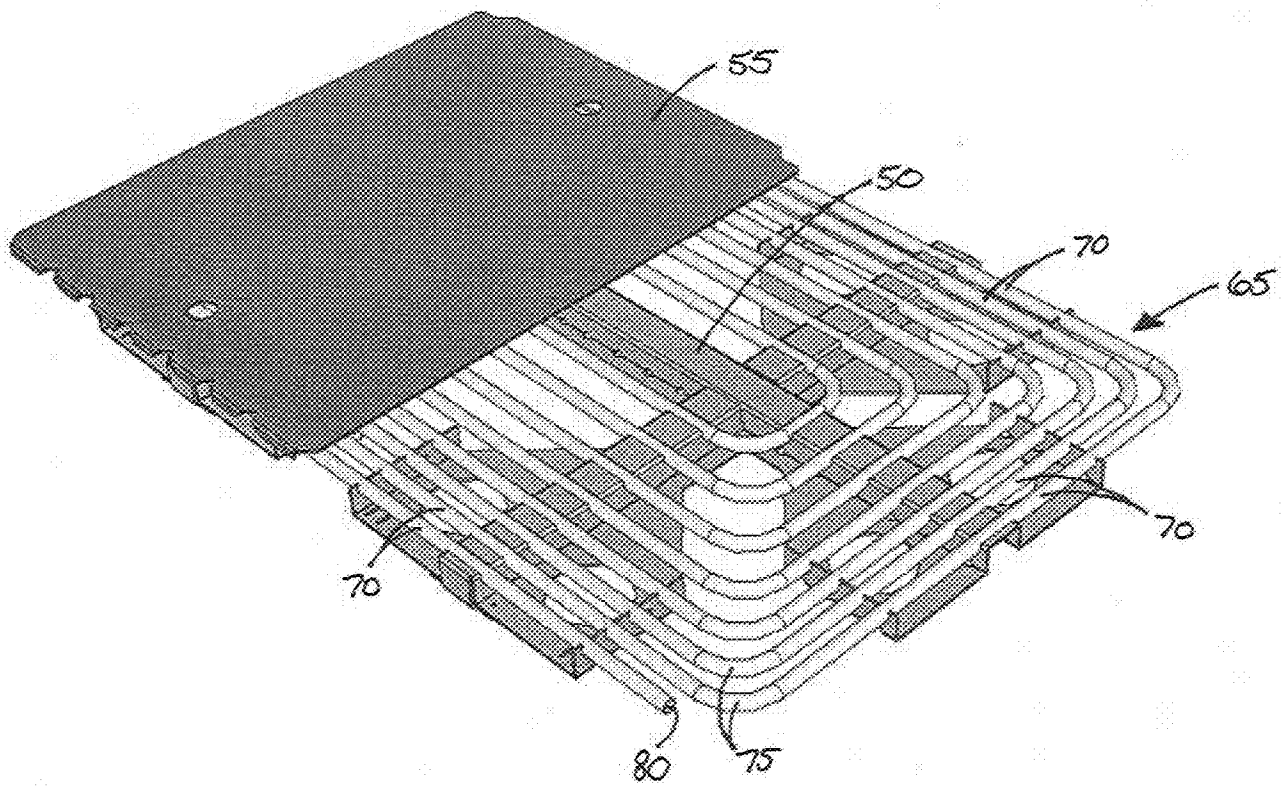
FIG. 4 is a perspective view of the heat exchanger, the frame, and a conduction plate coupled to the heat exchanger.

With reference to FIGS. 3 and 4, the heat exchanger 40 is coupled to the case 15 by a frame 50, and a plate 55 is directly coupled to a top of the heat exchanger 40 to conductively transfer cold from the heat exchanger 40 to the platform 18 to refrigerate product situated on the platform 18. As will be appreciated, the plate 55 can be omitted such that the platform 18 is directly coupled to the heat exchanger 40. The illustrated heat exchanger 40 is embedded or nested in an insulative material 60 (e.g., injected foam, plastic, composite, etc.), although the heat exchanger 40 can have an open design (substantially or completely uninsulated). Embedding the heat exchanger 40 in the insulative material 60 increases the heat transfer between the platform 18 and the heat exchanger 40.

Figure 5:
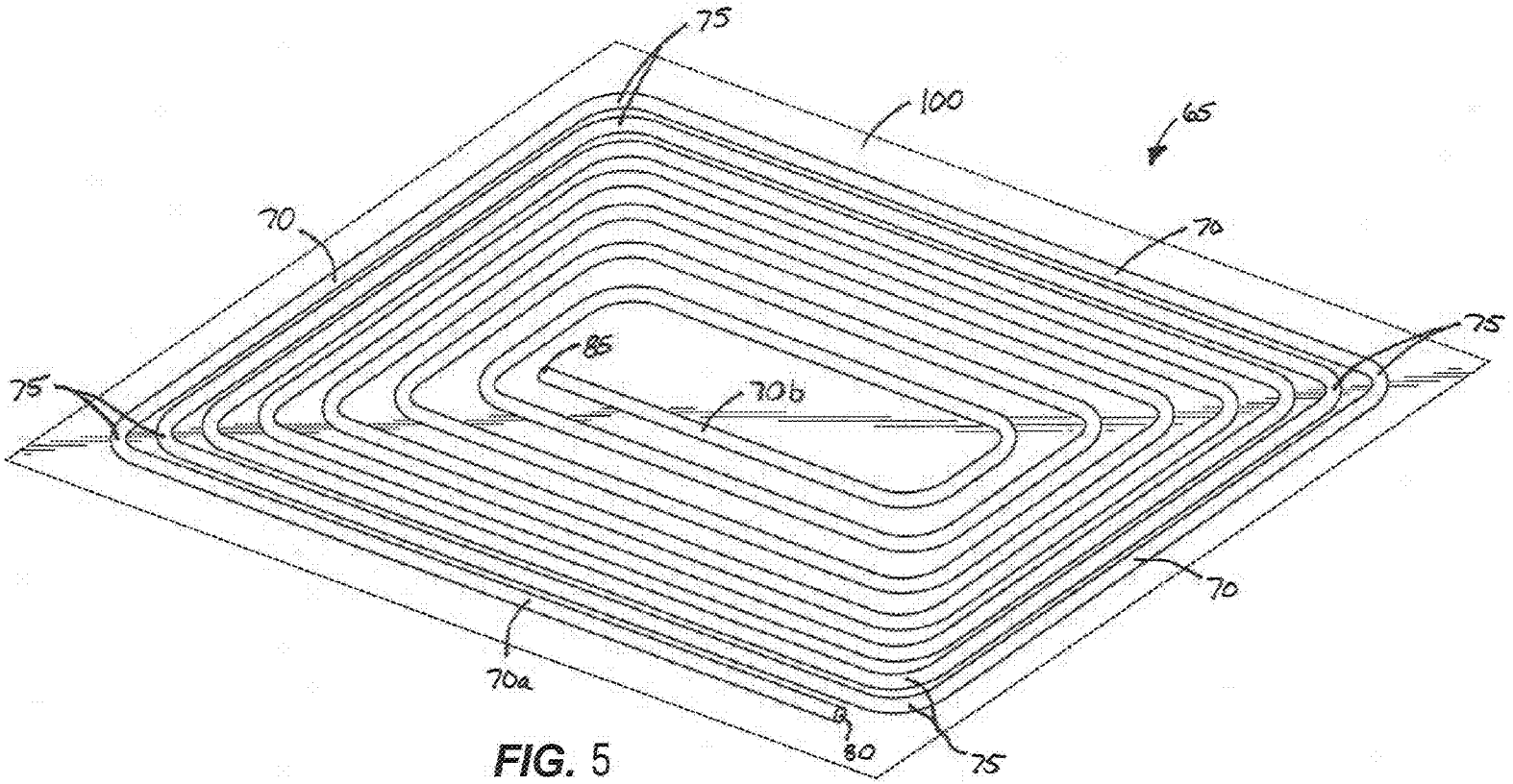
FIG. 5 is a perspective view of the heat exchanger including a non-linear coil.
Figure 6:
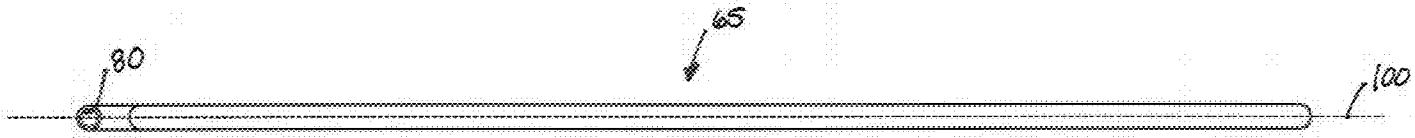
FIG. 6 is a side view of the coil of FIG. 5.
Figure 7:
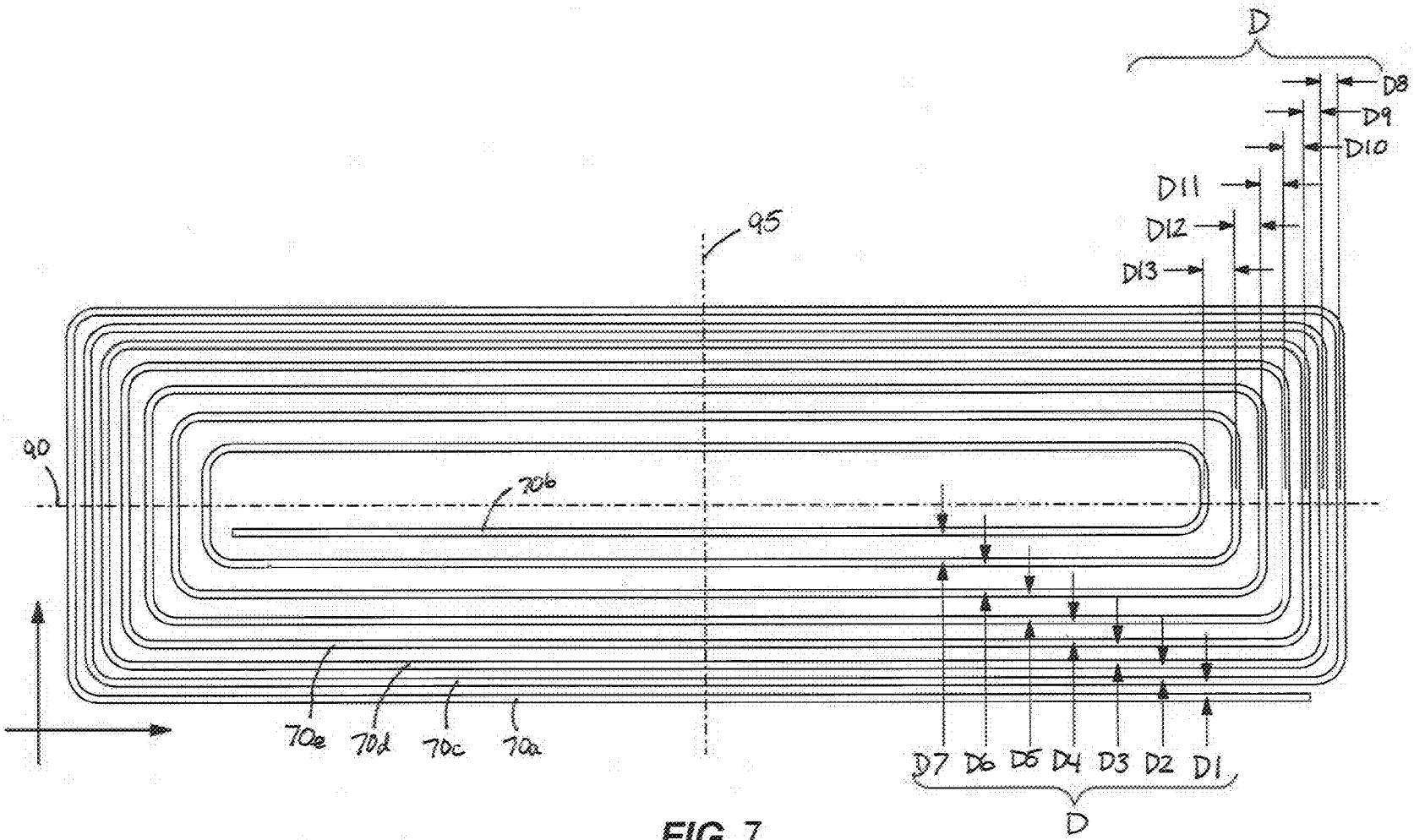
FIG. 7 is a top view of the coil of FIG. 5.

FIGS. 5-7 illustrate that the heat exchanger 40 includes a non-linear serpentine coil 65. More specifically, the non-linear coil 65 has coil sections 70 (e.g., each having a circular, elliptical, or polygonal cross-section) that are connected to each other by bends 75 to define a sinuous refrigerant path. As illustrated in FIGS. 5 and 7, the coil 65 has a spiral shape (e.g., involute or rolled or curled or whorled, etc.). The coil 65 is formed from a thermally conductive material (e.g., hard copper, soft copper, aluminum, etc.), and it will be appreciated that the coil 65 can have any quantity of coil sections 70 depending on design constraints for the heat exchanger 40 and/or other factors.

Referring to FIGS. 5 and 7, the coil 65 includes an inlet coil section 70*a* that has a refrigerant inlet 80 fluidly coupled to a refrigerant line 82 that is connected to a condenser, and an outlet coil section 70*b* that has a refrigerant outlet 85 fluidly coupled to a refrigerant line 87 that is connected to the priming device. The inlet 80 is positioned or located adjacent an outer periphery of the coil 65, and the outlet 85 is positioned or located inward of the outer periphery (e.g., closer to a longitudinal center of the coil 65, designated by an axis 95, than to the periphery of the coil 65). As illustrated, the inlet 80 is positioned at the outer periphery, and the outlet 85 is positioned adjacent the center 90 of the coil 65. That is, the outlet coil section 70*b* is positioned at the center of the coil 65 such that the section 70*b* is the coil section that is located closest to the longitudinal center 90 of the coil 65 (represented by an axis in FIG. 7). For example, the outlet coil section 70*b* can be on the longitudinal center axis 90. Referring back to FIGS. 1-3, the coil 65 is coupled to the case 15 so that the inlet coil section 70*a* is positioned toward and adjacent the front edge of the case 15, although the orientation can be reversed so that the inlet coil section 70*a* is positioned toward and adjacent the rear edge. As will be understood with reference to FIG. 7, the longitudinal direction of the coil 65 corresponds to the length L of the coil 65 that extends along the length of the case 15, and the lateral direction of the coil 65 corresponds to the width W of the coil 65 (i.e. extending along a lateral axis 95).

Referring to FIGS. 5 and 6, the coil 65 is planar such that the coil sections 70 lie in a single plane 100. Stated another way, the coil 65 does not have a change in height (upward as viewed in FIG. 3*b*) across the coil sections 70. As shown in FIG. 7, the coil sections 70 are monotonically spaced apart from each other (i.e. non-decreasing spacing) in the direction from the outer periphery of the coil 65 toward the center. Monotonically spaced coil sections 70 is intended to mean that the distance D between adjacent coil sections 70 (measured from center-to-center of each coil section) along either the axis 90 or the axis 95, or along both axes 90, 95, is variable and increases or is the same from the outer periphery of the coil 65 toward the center 90. More specifically, at least one distance Dx (where "x" is an integer) between adjacent coil sections 70 is larger than (increases relative to) at least one of the distances Dy (where "y" is an integer smaller than "x") between adjacent coil sections 70 that are located closer to the outer periphery, and that the distance Dx is the same as or smaller than a distance Dz (where "z" is an integer larger than "x") between adjacent coil sections 70 disposed inward of the coil sections 70 defining the distance Dx.

FIG. 7 illustrates the coil section spacing or distances D1-D7 measured along the lateral axis 95, and the coil section spacing or distances D8-D13 measured along the longitudinal axis 95. For example, and as shown, the distance D1 between the inlet coil section 70*a* and the nearest coil section 70*c* can be smaller than or the same as the distance D2 between the coil section 70*c* and the next inwardly disposed coil section 70*d*. The distance D2 between the coil section 70*c* and the coil section 70*d* is the same as the distance D1 between the inlet coil section 70*a* and the next coil section 70*c*. Also as shown, the distance D3 between the coil section 70*d* and the coil section 70*e* is larger than the distance D2, and the distance D4 is the same as the distance D3. Continuing with the illustrated example, the distance D5 is larger than the distance D4, and the distance D6 is larger than the distance D5. Also, the distance D7 is the same as the distance D6. As will be appreciated, the coil 65 can be designed so that different coil section pairs (e.g., D2 can be larger than D1, D3 can be the same as D2, etc.) are separated by distances that increase or stay the same as the coil section pairs located closer to the outer periphery.

With continued reference to FIG. 7, the distances D8-D13 measured along the longitudinal axis 95 can be the same as the corresponding distances D1-D6. For example, the distance D8 can be the same as D1, the distance D9 can be the same as the distance D2. In other words, and as illustrated in FIG. 4, the spacing between adjacent coil sections remains the same for one full revolution of the spirally-shaped coil 65. It will be understood and appreciated that one or more of the distances D8-D13 can differ from the corresponding distances D1-D6 while still defining monotonically spaced coil sections 70. Also, the coil 65 can have coil sections 70 that are spaced apart from each other (measured along one of the axes 90, 95) such that the distances D between the coil sections 70 increases successively from the outer periphery toward the center (i.e. the distance Dz is larger than any distance Dx or Dy).

Figure 8:
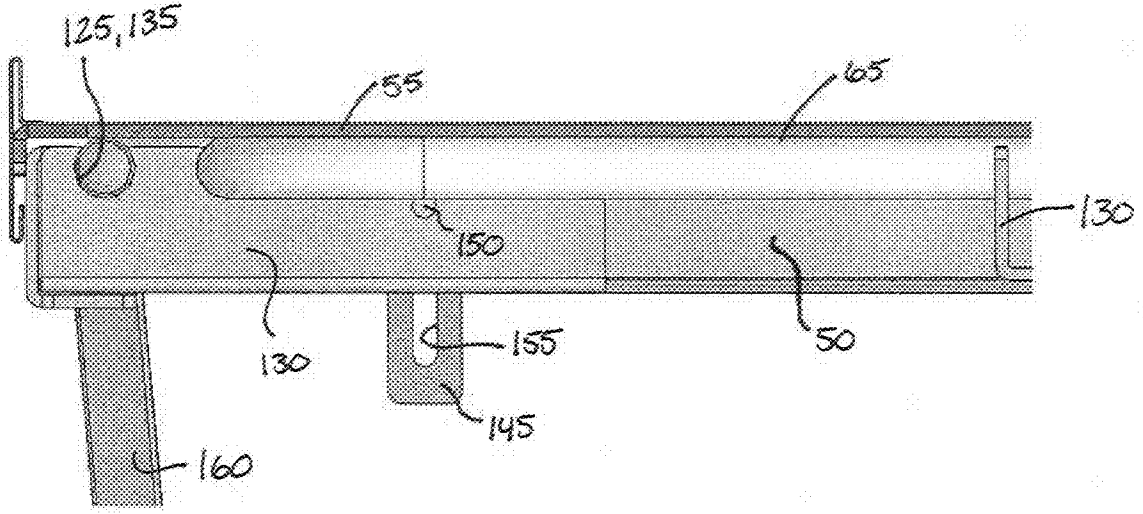
FIG. 8 is a side view of a portion of the heat exchanger supported by the frame.

Referring to FIGS. 4 and 8, the coil sections 70 are seated or nested on the frame 50 so that the top of the coil sections 70 extend above a top of the frame 50. In this manner, the coil sections 70 remain in contact with the plate 55 across the entire profile of the coil 65.

Figure 9:
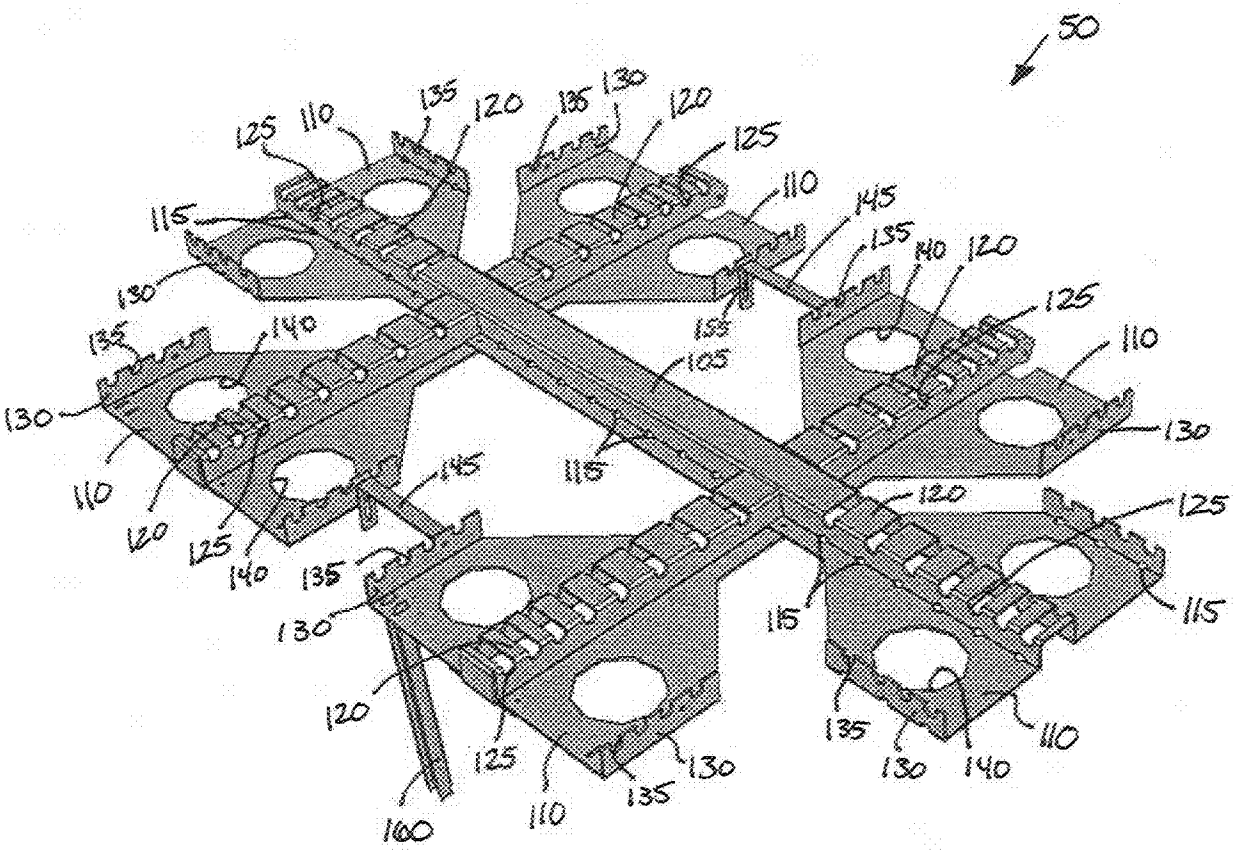
FIG. 9 is a perspective view of the frame.

As shown in FIG. 9, the frame 50 includes a main support bracket 105 and frame extensions 110 that are coupled to and extend outward from the support bracket 105 (e.g., illustrated in FIG. 9 in the form of a daisy chain arrangement) to support the coil 65 between the center of the coil 65 and the outer periphery of the coil 65. The support bracket 105 and the frame extensions 110 cooperate with each other so that the coil 65 remains flat or substantially flat to maximize the conductive heat transfer between the coil 65 and the plate 55. As illustrated, the support bracket 105 and some of the frame extensions 110 have a plurality of holes or apertures 115 adjacent a lower side of the structure to permit drainage of fluid (e.g., water formed from melted frost) so that fluid does not collect on the frame 50. As will be appreciated, holes 115 can be provided on some or all of the frame extensions 110, and the quantity of holes 115 can vary depending on design criteria. The frame 50 can be formed of any material suitable to structurally support the heat exchanger 40 within the case 15 (e.g., aluminum, stainless steel, composite, plastic, etc.).

With continued reference to FIGS. 8 and 9, each frame extension 110 has a central rib 120 (formed integrally with the support bracket 105 or coupled to the support bracket 105) that defines first pockets 125 (e.g., recesses, channels, grooves, notches, etc.) that support the coil sections 70. As illustrated, each frame extension 110 also has upwardly-turned flanges 130 that extend from the central rib 120. The flanges 130 are oriented along the lateral edges of the frame extension 110 and define second pockets 135 (e.g., notches, recesses, channels, grooves, etc.). The second pockets 135 are coextensive with the first pockets 125, and the depth of each pocket 125, 135 is selected so that the coil sections 70 protrude above the top of the frame 50. As will be appreciated, the spacing between adjacent first pockets 125 and between adjacent second pockets 135 on each of the frame extensions 110 is the same as the distances D between the corresponding coil sections 70 that are positioned in the respective pockets 125, 135. The illustrated frame extensions 110 also have cutouts 140 (e.g., to reduce the weight of the extensions).

FIG. 9 shows that handles 145 are coupled to the frame 50 between adjacent frame extensions 110. As illustrated, the handles 145 are attached to the exterior sides of the flanges 130 using fasteners 150, although other attachment points and attachment structure (welds, adhesive, mechanical attachment, etc.) can be used. The handles 145 are positioned on opposite sides of the frame 50 (e.g., to be positioned adjacent the front and rear edges of the case 15) and can be used to position the heat exchanger 40 and the frame 50, as a unit, into the case 15, and to lift the unit out of the case 15 (e.g., for servicing or replacement, etc.). Slots 155 in the handles 145 (see FIGS. 8 and 9) permit access to the handles 145 by a user while also permitting the handles 145 to be recessed below the top of the frame 50.

With reference to FIGS. 3 and 9, a support post 160 can be removably or pivotably coupled to the frame 50 so that the heat exchanger 40 and the frame 50 (i.e. the unit) can be raised relative to the base 20 (e.g., to permit cleaning the underneath the unit). As illustrated, the support post 160 is attached to one of the frame extensions 110 such that the upper end of the frame support protrudes through the frame extension 110 (e.g., via slots or other openings in the frame extension 110). It will be appreciated that other forms of attachment are also possible and considered herein.

In operation, the monotonically spaced coil 65 has at least some of the distances D between adjacent coil sections 70 that are varied (i.e. different from other distances) so that the spacing between coil sections 70 adjacent the outer periphery is generally smaller than the spacing between the innermost coil sections 70. By providing tighter coil spacing near the outer periphery, the corners of the platform 18 can be cooled more evenly. Also, increasing the spacing between coil sections 70 near the center more evenly distributes cooling across the entire area of the platform 18, which helps to avoid product freezing. The heat exchanger 40 illustrated in FIGS. 1-4, with its monotonic coil 65, also superheats the cooling fluid toward the center of the coil 65, which further increases the control of temperature variance across the platform 18 (e.g., when a thermostatic sensor (not shown) of the refrigeration system is located away from the center of the coil 65).

Various features and advantages of the invention are set forth in the following claims.

The invention claimed is:

1. A heat exchanger comprising:

a non-linear coil having coil sections defining a sinuous refrigerant path, the coil including an inlet located on an outer periphery of the coil and an outlet located inward of the outer periphery, wherein a distance between the coil sections monotonically increases from the outer periphery toward the center.

2. The heat exchanger of claim 1, wherein the coil is defined by a spiral shape.

3. The heat exchanger of claim 1, wherein the coil lies in a single plane.

4. The heat exchanger of claim 1, wherein the coil is at least partially embedded in an insulative material.

5. The heat exchanger of claim 1, wherein the outlet is positioned adjacent a center of the coil.

6. A heat exchanger comprising:

a non-linear coil having coil sections defining a sinuous refrigerant path, the coil including an inlet located on an outer periphery of the coil and an outlet located interior of the outer periphery such that the coil section defining the outlet is positioned closest to and extends along a longitudinal axis of the coil, wherein the longitudinal axis extends along a center of the coil, wherein a distance between the coil sections monotonically increases from the outer periphery toward the center.

7. The heat exchanger of claim 6, wherein the coil lies in a single plane.

8. The heat exchanger of claim 6, wherein the coil is defined by a spiral shape.

9. The heat exchanger of claim 6, wherein the coil is at least partially embedded in an insulative material.

10. A heat exchanger comprising:

a non-linear coil lying in a single plane and having coil sections defining a sinuous refrigerant path, the coil having a spiral shape and including an inlet located on an outer periphery of the coil and an outlet located inward of the outer periphery, wherein a distance between the coil sections monotonically increases from the outer periphery toward the center.

11. The heat exchanger of claim 10, wherein the outlet is located at the center of the coil.

12. The heat exchanger of claim 10, wherein the coil is at least partially embedded in an insulative material.

13. The heat exchanger of claim 10, wherein the outlet is positioned adjacent a center of the coil.

14. A refrigerated merchandiser comprising:

a case including a base and defining a product display area disposed at least partially above the base; and a heat exchanger including a non-linear coil disposed in the case and positioned to conductively refrigerate product in the product display area, the coil having coil sections defining a sinuous refrigerant path, and the coil including an inlet located on an outer periphery of the coil and an outlet located inward of the outer periphery, wherein the coil is oriented in the merchandiser such that the coil section defining the inlet is positioned toward and adjacent either a front edge or a rear edge of the case, wherein a distance between the coil sections monotonically increases from the outer periphery toward the center.

15. The refrigerated merchandiser of claim 14, wherein the coil is defined by a spiral shape and lies in a single plane.

16. The refrigerated merchandiser of claim 14, wherein a first distance between an inlet coil section and an adjacent coil section spaced inward from the inlet coil section is smaller than a second distance between an outlet coil section and an adjacent coil section spaced outward from the outlet coil section.

17. The refrigerated merchandiser of claim 16, wherein the outlet coil section is located closer to a longitudinal center of the coil than any other coil section.

18. The refrigerated merchandiser of claim 14, wherein the coil is at least partially embedded in an insulative material.

19. The refrigerated merchandiser of claim 14, wherein the outlet is positioned adjacent a longitudinal center of the coil.

* * * * *